US006745651B2

(12) United States Patent
Porter

(10) Patent No.: US 6,745,651 B2
(45) Date of Patent: Jun. 8, 2004

(54) MANUAL DEVICE FOR APPLYING A CLAMPING PRESSURE TO THE HEAD OF A NUT

(75) Inventor: Jerry Porter, 2818 Jutland Rd., Kensington, MD (US) 20895

(73) Assignees: Jerry Porter, Kensington, MD (US); Bruce Galloway, Charlottesville, VA (US); Patrick Coffey, Afton, VA (US); Parker & DeStefano, PC, Charlottesville, VA (US)

( * ) Notice: Subject to any disclaimer, the term of this patent is extended or adjusted under 35 U.S.C. 154(b) by 0 days.

(21) Appl. No.: 10/202,574

(22) Filed: Jul. 24, 2002

(65) Prior Publication Data

US 2004/0089112 A1 May 13, 2004

Related U.S. Application Data

(60) Provisional application No. 60/308,006, filed on Jul. 26, 2001.

(51) Int. Cl.[7] ..... B25B 7/02

(52) U.S. Cl. ..... 81/426.5; 81/424.5; 81/415

(58) Field of Search ..... 81/300, 415, 418, 81/424.5, 426.5, 176.1, 176.2, 176.3; D8/4, 21–24, 27, 52, 54, 58

(56) References Cited

U.S. PATENT DOCUMENTS 519,550 A * 5/1894 Riordan ..... 7/130
607,436 A * 7/1898 Hilliker ..... 81/383.5
658,565 A * 9/1900 Deeble ..... 81/300
1,448,622 A * 3/1923 Frese et al. ..... 29/270
1,498,844 A * 6/1924 Laflin ..... 81/415
1,506,675 A * 8/1924 Seppman ..... 81/426.5
1,612,474 A * 12/1926 Strain ..... 29/270
1,805,884 A * 5/1931 Pawsat ..... 81/426.5
2,806,394 A * 9/1957 Briegel ..... 72/409.19
3,161,085 A * 12/1964 Pratt ..... 81/3.8
3,203,221 A * 8/1965 Conner ..... 72/409.01
4,474,059 A * 10/1984 Hoeptner, III ..... 73/119 R
5,007,312 A * 4/1991 Bailey ..... 81/426.5
5,531,141 A * 7/1996 Gilbert, Jr. ..... 81/426.5
5,931,067 A * 8/1999 Gold ..... 81/407
5,960,683 A * 10/1999 Malkin et al. ..... 81/165
6,401,578 B1 * 6/2002 Domenge ..... 81/424

* cited by examiner

*Primary Examiner*—Joseph J. Hail, III
*Assistant Examiner*—David B. Thomas
(74) *Attorney, Agent, or Firm*—Parker & DeStefano, P.C.

(57) ABSTRACT

A device for use in turning a nut relative to a bolt includes a first elongated inflexible member having a first handle end and a first jaw end. A second elongated inflexible member includes elongated members are pivotably connected to each other. Each jaw is dimensioned to engage in combination substantially the entire peripheral surface of a nut, but less than the entire surface of the head of the nut such that the jaws ends can not touch each other when the jaws are separated by a nut.

16 Claims, 1 Drawing Sheet

MANUAL DEVICE FOR APPLYING A CLAMPING PRESSURE TO THE HEAD OF A NUT

This application claims the benefit of Provisional application Ser. No. 60/308,006, filed Jul. 26, 2001.

FIELD OF THE INVENTION

The present invention relates to a non-adjustable wrench in which the jaws are made to conform to the periphery of a single size of nut by means of a pivoting action, more particularly, the invention relates to pliers that have the clamping jaws similar to that of a split wrench.

BRIEF DESCRIPTION OF THE INVENTION

Figure 3:
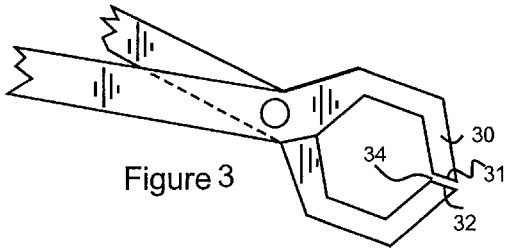
FIG. 3 is a fragmentary plan view of the embodiment of FIG. 2, shown without a nut between the jaws.
Figure 2:
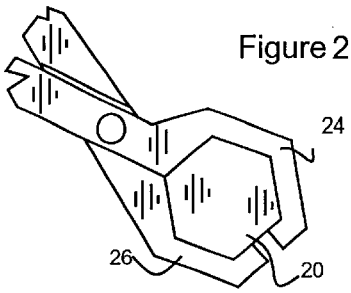
FIG. 2 is a fragmentary plan view of another embodiment of a device in accordance with the present invention, in engagement with the head of a nut.
Figure 3A:
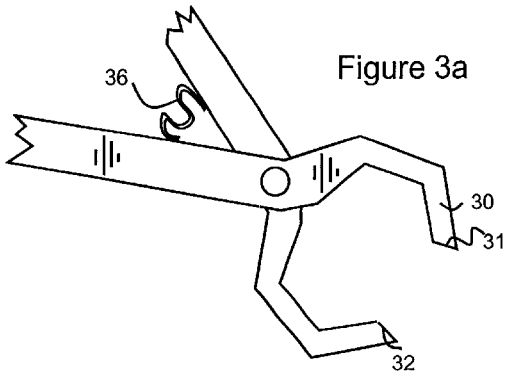

FIG. 3*a* is a fragmentary plan view of the embodiment of FIG. 2, shown with the jaws in the open position.

Figure 4:
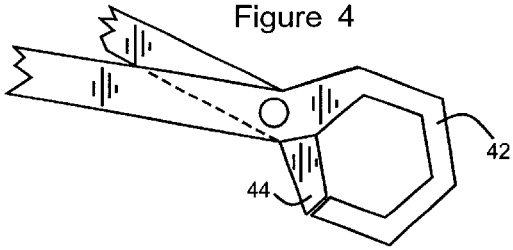

FIG. 4 is a fragmentary plan view of a further embodiment of a device in accordance with the present invention, shown without a nut between the jaws.

Figure 5:
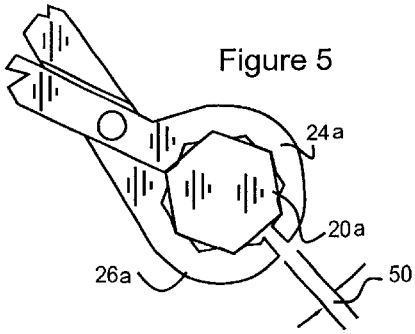

FIG. 5 is a fragmentary plan view of a further embodiment of a device in accordance with the present invention, shown with a nut between the jaws, and having 12 apices rather than the 6 apices of FIG. 2.

Figure 6:
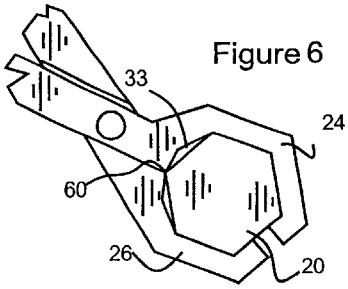

FIG. 6 is a fragmentary plan view of a further embodiment of a device in accordance with the present invention, shown with a nut between the jaws, and having a cross section similar to that of an open ended wrench.

Figure 7:
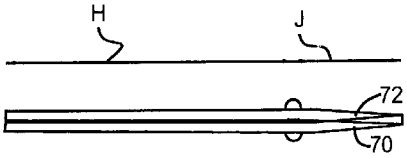

FIG. 7 is an edge view of a further embodiment of a device in accordance with the present invention, shown with the jaws at a slight angle relative to the handles.

DESCRIPTION OF THE PREFERRED EMBODIMENTS OF THE INVENTION

The present invention is a wrench in which the jaws are adjusted by means of a pliers type of pivoting action. It thus has the features of both a wrench and pliers. By way of contrast with the prior art, the present invention is directed to a tool that is uniquely suited to removing nuts from bolts where the nut is frozen to the bolt, as for example due to rusting. Additionally, it is suitable for use in applying a high degree of torque to a nut during the process of threading the bolt into the nut or unthreading the bolt from the nut. The problem that is generally encountered in such high force applications, is that the wrench makes contact with only the peaks of the nut, as for example, hexagonal nuts, and consequently strips the nut. Once the nut is transformed from a hexagon to a circular cross-sectional object, removal of the nut become essentially impossible.

The invention can be understood by viewing it in contrast to the prior art device of U.S. Pat. No. 5,887,492. In the device of the patent, a mechanics' limited-access nut starter instrument is provided. It has a precision hexagonal nut holding capability in limited-access mechanical areas commonly encountered by mechanics. Because a hexagonal recess is provided slightly undersized with respect to its intended nut size, the instrument actually begins to hold a nut prior to locking with serrated locking extensions. To accomplish this goal, the instrument's handles or gripping extensions must be sufficiently flexible to permit the instrument to flex sufficiently for the serrated locking extensions to engage. Obviously, this flexibility prevents the instrument from applying a high amount of torque, since the device can flex and the nut can rotate relative to the hexagonal recess.

By way of contrast, in the present invention, it is critical that the instrument be inflexible. The term inflexible is employ herein in accordance with its standard dictionary definition, as follows:

Inflexible. adj.

1. Not easily bent; stiff or rigid.
2. Incapable of being changed; unalterable.
3. Unyielding in purpose, principle, or temper; immovable.—in-flex'i-bil'i-ty or in-flex'i-ble-ness n.—in-flex'i-bly adv.

SYNONYM: inflexible, inexorable, adamant, obdurate.

Thus, the term inflexible, as employed herein, refers to a structure in which the jaws will not open due to flexion when the handles are maintained in a hand pressure-fixed position and the device is used to apply a predetermined minimum turning force or torque to the nut. An inflexible device can apply a sufficient force to shear the bolt. A flexible device cannot shear a bolt because the jaws will flex open and permit relative movement between the jaws and nut, before a shear force can be exerted to the bolt. A starter wrench need not apply a significant force since it is only used to make contact with a few threads.

Torque: The term torque, as employed herein, refers to the moment of a force and is the measure of a force's tendency to produce torsion and rotation about an axis, equal to the vector product of the radius vector from the axis of rotation to the point of application of the force. Simply, torque refers to a turning or twisting force.

Pliers. A variously shaped hand tool having a pair of pivoted jaws, used for holding, bending, or cutting.

Wrench. Any of various hand or power tools with fixed or adjustable jaws for gripping, turning, or twisting objects such as nuts, bolts, or pipes.

The predetermined minimum torque is relative to the application to which the device is being applied. In the automotive industry, the nut, spark plug, or the like, is torqued to a maximum force that is typically in excess of 15 ft. lbs. At this point the object is exerting a substantial resistance to being tightened. The maximum torque that can be applied by a starter wrench is very substantially below the 15 ft. lbs level and can be as low as a few ft. lbs.

In the case of lug nuts the minimum required force can be in the range from approximately 90 to 100 ft. lbs. Automobile suspension members can require about 200 ft. lbs of torque for proper tightening. The force necessary to shear a bolt with a frozen nut would be substantially higher than the maximum torque that would be used to tightened the nut on the bolt. Thus, a minimum tightening force that is required of the device of the present invention is greater than 15 ft. lbs. Preferably the force should be at least 50 ft. lbs in order to be able to properly tighten a major portion of the bolts used, for example, on cars. It is of even greater advantage to be able to accommodate virtually all of the bolts in a wide range of industries, by providing for the application of at least 100 or more preferably, 200 ft. lbs. of torque or even higher, to be able to shear bolts.

The term inflexible is used herein, to distinguish from the structures of starter wrenches, as described, for example, in the U.S. Pat. No. 5,887,492 and GB 1417637 patents. Standard pliers have inflexible handles, though the handles may be able to flex to an almost imperceptible extent.

There is a feed back sensation such that, for example, the user can sense the force being applied to the head of a nut. The device of the present invention, and standard pliers, are designed to enable the user to apply an extreme level of torque such that it can be possible to break loose a nut frozen to a bolt by rust. Conversely, an extreme level of torque can be applied to achieve an extremely tight fit of a nut on a bolt. The design of the present invention serves to overcome problems that are encountered when a high level of torque is applied to the nut. The problems are encountered because, for example, the metal of the nut may be soft and easily deformed or the nut may be slightly undersized such that the force is applied just to the apices of the nut, resulting in the deformation of the nut.

By way of contrast, the device of U.S. Pat. No. 5,887,492 is sufficiently flexible, such that the handle can flex thereby enabling the handle locking mechanism to be engaged and disengaged while the jaws are clamped around the head of the nut. The U.S. Pat. No. 5,887,492 patent describes the device as a starter device. The flexibility of the head and handles of U.S. Pat. No. 5,887,492 results in the jaws opening when a high level of torque is applied to the nut. This is in direct conflict with the requirements of the tool of the present invention, because the tool of the present invention is designed to prevent the nut from moving out of firm engagement with the jaws when a high level of torque is applied to the nut. As noted above, a problem encountered with prior art devices is that under high torque, the head of the nut can be stripped to an almost round configuration. The design of the structure of the present invention is such that under high torque, the surface contact between the jaws of the device and the nut is sufficiently uniform around the circumference to negate the typical stripping or damaging of the nut.

The device of the U.S. Pat. No. 5,887,492 patent would not tend to damage a nut by virtue of the flexibility of the jaws and the handle. Thus, with the U.S. Pat. No. 5,887,492 device, under high torque the jaws will open. In the present device, under high torque, the user can apply sufficient pressure to prevent the jaws from opening and the jaws and handles are sufficiently inflexible to such that the jaws remain locked around the nut.

Looking at the picture from another perspective, with the U.S. Pat. No. 5,887,492 device, the maximum force that can be applied by the user to the nut is limited by the flexibility of the jaws and handles. Starter wrenches such as those of U.S. Pat. No. 5,887,492, encounter an insignificant amount of torque resistance.

By way of contrast, the device of the present invention is designed such that the maximum force that can be applied by the user to the nut is limited by the physical strength of the user, since the jaws and handles are essentially inflexible. Moreover, the dimensions the device is such that the two heads do not touch or come into contact during use. The distance between opposing faces of the nut must be slightly larger than the minimum distance between corresponding opposing faces on the head of the wrench when the wrench is in its maximum closed position. This serves the purpose of accommodating slight variations in head dimensions and permits the user to exert a force limited only by the physical strength of the user. The dimensions of the nut contacting surfaces of the wrench jaws are such that the wrench can accommodate a single predetermined nut size, with approximately a plus/minus tolerance of about $1/64^{th}$ of an inch. It is noted, that open-ended wrenches must provide a clearance and must accommodate some level of dimension variation. Accordingly, they tend to round off the heads of nuts when high levels of torque are applied, particularly, because nuts are generally made of a soft metal. With the plier's design of the present invention, firm contact is made with the nut and a high level of firm contact pressure can be maintained on the nut as a high torque is applied.

The tool of the present invention is thus in the form of pliers having wrench type gripping jaws. The jaws are movable relative to each other about a pivot point. For convenience, one jaw shall be referred to as a fixed jaw and the other as a movable jaw, although either or both jaws could be considered movable. Since one jaw must move relative to the other jaw but it is not essential that both jaws move relative to the nut that is being gripped, the terms fixed jaw and movable jaw are employed herein.

Unlike the device of U.S. Pat. No. 5,894,768, the user brings the handles of the pliers together and can feel the amount of force that is being applied to the nut. In the '768 tool, the two jaws are moved together by a thread mechanism, whereas in the present invention, the jaws are manually forced together.

Figure 1:
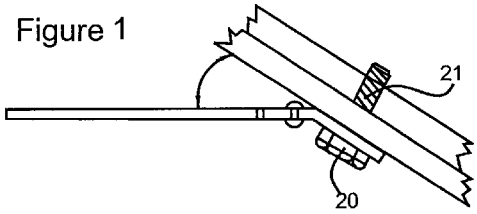
FIG. 1 is a fragmentary side view of a device in accordance with the present invention, in engagement with the head of a nut.

The present tool can be used to firmly grip the head 20 of the threaded nut 21, as illustrated in FIG. 1, and thus there is no play or slack between the jaws 24 and 26 and the nut, as best seen in FIG. 2. It is seen in FIG. 1, that the jaws of the device can be offset relative to the handles, for ease of access to the nut in certain applications.

The degree of play that can be encountered with a tool such as that of '768 can result in the jaw contact being at the apices, resulting in the apices being stripped from the head of the nut. Other wrenches such a locking adjustable wrenches apply force to two parallel sides of the nut, resulting in distortion of the nut, which can lead to breaking, or jamming of the nut. Once the head is rounded off, the nut is useless. By way of contrast, in the present invention, the jaws contact substantially the entire perimeter of the nut, thereby applying a force uniformly to the entire perimeter of the nut.

The split in the jaws is preferably designed to produce two equal halves as illustrated in FIG. 3. With this design the pliers can readily be opened (jaws spread apart) as illustrated in FIG. 3*a*, the jaws placed around the head of a nut as illustrated in FIG. 2, pressure (squeezing with the user's hand) and a rotation force applied. The opening action can be facilitated by a spring, such as spring 36. The spring can be of any design, such as coil, leaf, spiral, or the like. The pliers can be held in the locked position by means of a locking mechanism such as used on vise grip type of pliers.

In an alternate embodiment as illustrated in FIG. 4, the split is such that the first jaw 42 encompasses the head of the nut and holds the nut head. The second jaw 44 is used to bring pressure against the head and firmly grip the head. The clearance that must be provided for the head of the nut to slide within the jaw 42 is compensated for by the pressure applying jaw 44. That is, the clearance is eliminated when the jaws are brought together and pressure is applied to the head of the nut.

The two sections of the pliers can be formed by metal stamping of two identical elements. In such a case the jaws are in reversed orientation such that the jaws are movable in opposition to each other. The jaw ends of the units can be offset slightly such that the jaws are in opposition to each other and the two ends 31 and 32 come into opposing, that is, mating relationship with the nut. Mating relationship does not imply that the ends of the jaws come into contact. This would prevent the jaws from being squeezed against the nut. The space between the jaw ends is identified in FIG. 3, as 34, and in FIG. 5, as 50.

A slight offset of the handles from the jaws 70 and 72, of about 15 degrees as illustrated in FIG. 7 can be used to keep both jaws in the same plane. Alternatively, the units can be notched to achieve the planar relationship, as well known in the art.

An alternative embodiment of the invention is shown in FIG. 5, wherein the jaws approximate the cross section of a socket wrench. In this embodiment, the wrench maintains the advantages of contact at all apices and at least partial contact with the flat surfaces of the nut as well as the ability to conform to the exact size of the nut by squeezing the handles of the wrench.

An alternative embodiment of the invention is shown in FIG. 6, wherein the jaws approximate the cross section of a modified open-end wrench. In this embodiment, the wrench maintains the advantages of contact at most of the apices and at contact with several of the flat surfaces of the nut as well as the ability to conform to the exact size of the nut by squeezing the handles of the wrench. A space 33 is provided between the wrench and the nut. Specifically, in this embodiment the intersection 60 of the jaws do not conform to the apices and flat surfaces of the nut. That is, the jaws are slightly spaced from the nut at the region of the intersection 60 of the jaws.

Preferably, the nuts receiving regions of the jaws are dimensioned to received a predetermined size nut. A tolerance of plus/minus $1/64^{th}$ of an inch can be used to accommodate a slight variation in the manufacturing tolerances of nuts.

The distance H, from the end of the handles to the pivot point, relative to the distance J from the end of the jaws to the pivot point, (as seen in FIG. 7) determines the mechanical advantage. The critical distance is from the center of the region of the handles that is being held by the user and the center of the head of the nut, as for example, nut 20*a* of FIG. 50. For simplicity, the reference points are the ends of the jaws and the ends of the handles. This approximation is sufficiently accurate for the purposes of this invention. The relative lengths of the jaws and the handles must be such that a user can apply a sufficient torque to the nut. The length of the distance "H" must be substantially greater than "J". If the length J was approximately equal to or greater than the length H, then the average user could not apply a sufficient closing force on the jaws while apply a torque of 15, 50, 100, or 200 ft. lbs.

The foregoing described embodiments are representative of the invention and the scope of the invention includes equivalent embodiments.

What is claimed is:

1. A device for use in turning a nut relative to a bolt, comprising:

a first elongated inflexible member having a first handle end and a first jaw end, said first jaw end including a jaw member, said jaw member having a first nut engaging section formed thereon, said nut being a polygon having a plurality of parallel sides, a second elongated inflexible member including a second handle end and a second jaw end, said second member second jaw end having a second nut engaging section formed thereon, said first elongated member being pivotably connected to said second elongated member, about a fixed pivot point, between said jaw ends and said handle ends, each jaw being dimensioned to engage in combination at least 80% of the peripheral surface of a nut, but less than the entire surface of the nut such that said jaws ends and said handle ends can not touch each other when the jaws are separated by a nut.

2. The device of claim 1, wherein in combination the jaws engage at least 90% of the peripheral surface of the nut.

3. The device of claim 1, wherein in combination the jaws engage at least 95% of the peripheral surface of the nut.

4. The device of claim 1, wherein in combination the jaws engage at least 98% of the peripheral surface of the nut.

5. A method of applying a high degree of torque to a nut on a bolt comprising the steps of:

a. engaging the head of a nut with the jaws of a manual tool, said tool having a first elongated inflexible member including a first handle end and a first jaw end, said first jaw end including a jaw and having a first nut engaging section formed thereon, a second elongated inflexible member including a second handle end and a second jaw end, said second member second jaw end having a second nut engaging section formed thereon, said first elongated member being pivotably connected to said second elongated member, for movement about a fixed pivot point, said first jaw and said second jaw, in combination, being dimensioned to engage at least 80% of the surface of a plurality of flat peripheral surfaces of a nut, but to enclose said nut less than totally when said fixed jaw and said fixed jaw fully engage said nut, such that said fixed jaw does not engage said movable jaw when said nut is fully engaged, b. manually applying a closing force to said second member relative to said first member, c. applying and manually maintaining a gripping pressure on said nut and engaging substantially the entire perimeter of said nut with the nut gripping surface of said first member's jaw and with the nut gripping surface of said second member's jaw, and d. applying a turning force to said nut by rotating said tool relative to said nut while manually maintaining said gripping pressure, said turning force being applied to substantially the entire perimeter surface of said nut but less than the entire surface of the nut.

6. A method of applying a high degree of torque to a nut on a bolt comprising the steps of a. engaging the head of a nut with the jaws of a manual tool, said tool having a first elongated inflexible member including a first handle end and a first jaw end, said first jaw end having a first nut engaging section formed thereon, a second elongated inflexible member including a second handle end and a second jaw end, said second member second jaw end having a second nut engaging section formed thereon, said first elongated member being pivotably connected to said second elongated member for movement about a fixed pivot point, said first jaw end and said second jaw end, in combination, being dimensioned to engage every flat peripheral surface of a nut, but to enclose said nut less than totally when said first jaw end and said second jaw end fully engage said nut inclusive of every apex, such that said first jaw end does not engage said second jaw end when said nut is fully engaged, b. applying a closing force to said second member relative to said first member, c. applying and manually maintaining gripping pressure on said nut and engaging each apex and substantially the entire perimeter of said nut but less than the entire surface of the nut between said nut engaging section of said first jaw and the nut engaging section of said second jaw, and d. applying a turning force to said nut by rotating said tool relative to said nut while maintaining said gripping pressure, said turning force being applied to substantially the entire perimeter surface of said nut but less than the entire surface of the nut.

7. The method of claim 6, where said at least a plurality of flat peripheral surfaces is at least 80% of said surfaces.

8. The method of claim 6, where said at least a plurality of flat peripheral surfaces is at least 90% of said surfaces.

9. The method of claim 5, wherein said turning force is in excess of 15 ft. lbs.

10. The method of claim 5, wherein said turning force is in excess of 50 ft. lbs.

11. The method of claim 5, wherein said turning force is in excess of 200 ft. lbs.

12. The device of claim 1, wherein said device is sufficiently inflexible to apply a torque in excess of 15 ft. lbs.

13. The device of claim 1, wherein said device is sufficiently inflexible to apply a torque in excess of 50 ft. lbs.

14. The device of claim 1, wherein said device is sufficiently inflexible to apply a torque in excess of 200 ft. lbs.

15. The device of claim 1, where said nut is hexagonal.

16. A device for use in turning a nut relative to a bolt, comprising:

a first elongated inflexible member having a first handle end and a first jaw end, said first jaw end including a jaw member, said jaw member having a first nut engaging section formed thereon, said nut being a polygon having a plurality of parallel sides, a second elongated inflexible member including a second handle end and a second jaw end, said second member second jaw end having a second nut engaging section formed thereon, said first elongated member being pivotably connected to said second elongated member, about a fixed pivot point, between said jaw ends and said handle ends, each jaw being dimensioned to engage in combination at least 60% of the peripheral surface of a nut, but less than the entire surface of the nut such that said jaws ends and said handle ends can not touch each other when the jaws are separated by a nut, said jaws being dimensioned to form a polygon within $1/64^{th}$ of an inch of the dimension of a predetermined size nut.

* * * * *